US007954283B1

(12) United States Patent
Tinianov

(10) Patent No.: US 7,954,283 B1
(45) Date of Patent: Jun. 7, 2011

(54) FIBROUS AEROGEL SPACER ASSEMBLY

(75) Inventor: Brandon D. Tinianov, Santa Clara, CA (US)

(73) Assignee: Serious Materials, Inc., Sunnyvale, CA (US)

( * ) Notice: Subject to any disclaimer, the term of this patent is extended or adjusted under 35 U.S.C. 154(b) by 0 days.

(21) Appl. No.: 12/124,609

(22) Filed: May 21, 2008

(51) Int. Cl.
*E06B 7/00* (2006.01)

(52) U.S. Cl. ..... 52/204.593; 52/786.11; 52/786.13

(58) Field of Classification Search ..... 52/205.593, 52/786.1, 786.13, 783.1, 788; 428/34
See application file for complete search history.

(56) References Cited

U.S. PATENT DOCUMENTS

| | | | | | |
|---|---|---|---|---|---|
| 3,553,913 | A | | 1/1971 | Eisenberg | |
| 3,919,023 | A | * | 11/1975 | Bowser et al. | 156/107 |
| 4,113,905 | A | | 9/1978 | Kessler | |
| 4,186,522 | A | * | 2/1980 | Hooks | 49/63 |
| 4,198,254 | A | | 4/1980 | Laroche et al. | |
| 4,222,213 | A | | 9/1980 | Kessler | |
| 4,226,063 | A | * | 10/1980 | Chenel | 52/172 |
| 4,431,691 | A | * | 2/1984 | Greenlee | 428/34 |
| 4,462,390 | A | * | 7/1984 | Holdridge et al. | 126/587 |
| 4,564,540 | A | * | 1/1986 | Davies et al. | 428/34 |
| 4,831,799 | A | | 5/1989 | Glover et al. | |
| 5,007,217 | A | * | 4/1991 | Glover et al. | 52/172 |
| 5,286,537 | A | | 2/1994 | Oita et al. | |
| 5,290,611 | A | | 3/1994 | Taylor | |
| 5,485,709 | A | | 1/1996 | Guillemet | |
| 5,514,428 | A | | 5/1996 | Kunert | |
| 5,683,764 | A | * | 11/1997 | Alts | 428/34 |
| 5,973,015 | A | * | 10/1999 | Coronado et al. | 521/64 |
| 6,035,602 | A | | 3/2000 | Lafond | |
| 6,068,882 | A | | 5/2000 | Ryu | |
| 6,136,446 | A | | 10/2000 | Virnelson et al. | |
| 6,581,341 | B1 | | 6/2003 | Baratuci et al. | |
| 6,887,563 | B2 | * | 5/2005 | Frank et al. | 428/312.6 |
| 6,989,188 | B2 | | 1/2006 | Brunnhofer et al. | |
| 7,078,359 | B2 | * | 7/2006 | Stepanian et al. | 442/59 |
| 7,270,851 | B2 | | 9/2007 | Sullivan | |
| 7,270,859 | B2 | | 9/2007 | Acevedo et al. | |
| 2006/0263587 | A1 | | 11/2006 | Ou et al. | |
| 2007/0116907 | A1 | * | 5/2007 | Landon et al. | 428/34 |
| 2009/0029147 | A1 | | 1/2009 | Tang et al. | |
| 2010/0139193 | A1 | | 6/2010 | Goldberg et al. | |

OTHER PUBLICATIONS

Linear Expansion Coefficients Table—http://web.archive.org/web/20060222145423/http://www.engineeringtoolbox.com/linear-expansion-coefficients-d_95.html—Feb. 22, 2006.*
Aspen Aerogels Cryogel product data sheet, 2007 pp. 1-4.
Aspen Aerogels Spaceloft Insul-Cap Brochure, 2007 1-4.
Selkowitz, et al. "Window Systems for Hih-Performance Buildings", Norton & Co, 2003, p. 93.
"US DOE Envelope and Windows R&D Roadmap", presentation presented at the US DOE Envelope and Windows R&D Roadmap Workshop Buildings Conference, Dec. 6, 2007, pp. 1-14.
"Aspen Aerogel Translucent Panels Presentation", presented at the US DOE Envelope and Windows R7D Roadmap Workshop Buildings Conference, Dec. 6, 2007, p. 1.

(Continued)

*Primary Examiner* — Brian E Glessner
*Assistant Examiner* — Adam Barlow
(74) *Attorney, Agent, or Firm* — Haynes and Boone, LLP

(57) ABSTRACT

An insulating spacer for creating a thermally insulating bridge between spaced apart panes of a multiple pane window unit comprises in one embodiment, a solid profile of fiber-stabilized aerogel insulation material, treated to be non-porous along its exposed surface. The spacer defines a thermally insulated space between the panes. The result is higher thermal performance for insulated glass units and windows employing these insulated glass units.

14 Claims, 7 Drawing Sheets

OTHER PUBLICATIONS

PCT International Search Report and the Written Opinion mailed Jan. 28, 2010, in related International Application No. PCT/US2009/066575.
ASTM International, www.astm.orq, retrieved on Mar. 31, 2010.
S.J. Teichner, et al., "Inorganic Oxide Aerogel", Advances in Colloid and Interface Science, vol. 5, pp. 245-273, 1976.
L.D. Lemay, et al., "Low-Density Microcellular Materials", MRS Bulletin, vol. 15, p. 19, 1990.

* cited by examiner

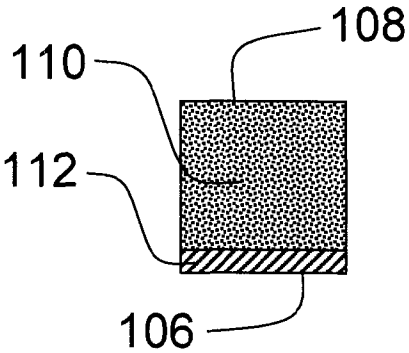
FIG. 2a
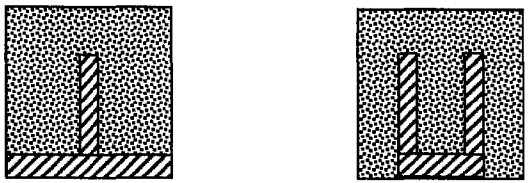
FIG. 2b
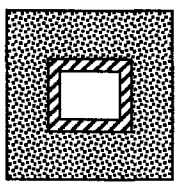
FIG. 2c
FIG. 2d
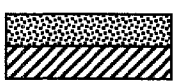
FIG. 2e
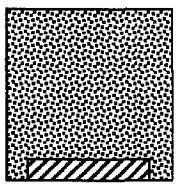
FIG. 2f
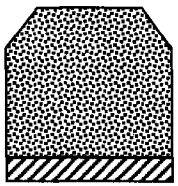
FIG. 2g
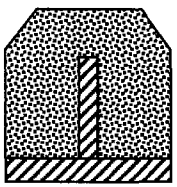
FIG. 2h
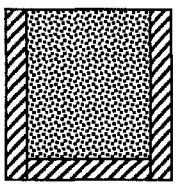
FIG. 2i

FIBROUS AEROGEL SPACER ASSEMBLY

FIELD OF THE INVENTION

This invention generally relates to an insulating spacer and in particular to an insulating spacer for creating a thermally insulating bridge between spaced-apart panes in a multiple glass panel window unit, for example, to improve the thermal insulation performance of the unit. This invention also relates to methods of making such an insulating spacer.

BACKGROUND OF THE INVENTION

An important consideration in the construction of buildings is energy conservation. In view of the extensive use of glass in modern construction, a particular problem is heat loss through glass surfaces and glazed building envelopes. One solution to this problem has been an increased use of insulating glass units comprising basically two or more glass panels separated by a sealed dry air space. Sealed insulating glass units generally require some means of mechanically separating the glass panels by a precise distance, such as by rigid spacers.

The spacers historically used are rectangular channels made of steel, aluminum or some other metal, with an internal desiccant to adsorb moisture from the space between the glass panels and to keep the encapsulated sealed air space dry. Tubular spacers are commonly roll-formed into the desired cross sectional shape. Steel spacers are generally considered the cheapest and strongest option, but aluminum spacers are easier to cut and form into non standard window shapes such as semicircles. Aluminum also provides lightweight structural integrity, but it is more expensive than steel. Metal spacers are manufactured by PPG of Pittsburgh, Pa. and Allmetal Inc. of Itasca, Ill. Spacers made entirely of plastic or from a combination of metal and plastic, termed warm edge spacers, have also been used to a limited extent. Manufacturers of these types of spacers include EdgeTech I.G., Inc. of Cambridge, Ohio and Swisspacer of Kreuzlingen, Switzerland.

There are specific factors that influence the suitability of the spacer material or design for use in high performance windows. Of most importance are the spacer's heat conducting properties and the spacer material's coefficient of thermal expansion. To date, metal has been the most widely used spacer material even though as a material it has a number of disadvantages in both of these areas. First, the thermal conductivity of metal is unacceptably high for use as a spacer. Since a metal spacer is a much better conductor of heat than is the glass or the air space between the panes of glass, its use leads to the rapid transfer of heat between the inside glass pane and the outside glass pane resulting in heat dissipation, energy loss, moisture condensation and other window assembly performance shortcomings. For example, in a sealed insulated glass unit, heat from within a building tries to escape in winter, and it takes the path of least resistance. The path of least resistance is around the perimeter of a sealed window unit, where the metal spacer bar is located. Metal spacers contacting the inner and outer panes of glass act as conductors between the panes and provide an easy path for the transmission of heat from the inside glass panel to the outside panel. As a result, under low temperature conditions in winter, condensation of moisture can occur inside the insulating glass or on the surfaces of the inner glass panel. Also, heat is rapidly lost from around the perimeter of the window, often causing a ten to twenty degree Fahrenheit temperature drop at the perimeter of the window relative to the center thereof. Under extreme conditions in winter, a frost line can occur around the perimeter of the window unit. These conditions undermine the energy efficiency of the window, and ultimately, the energy efficiency of the building itself.

A second important feature of the spacer material is its coefficient of thermal expansion. The coefficient of expansion of commonly used spacer materials is much higher than that of glass. Any difference in thermal expansion causes problems in the form of glass stress, seal shear and failure, or spacer damage. For example, the coefficient of linear thermal expansion for steel is twice that of glass ($17.3\times10^{-6}$ inches per deg K versus $8.5\times10^{-6}$ inches per deg K). This difference is particularly critical in climates that have large changes in temperature. As a result of such changes in temperature, stresses do develop at the interface between the glass and spacer bar and in the perimeter seal. This often results in damage to and failure of the sealed insulating glass unit, such as by sufficient lengthwise shrinkage of the spacer to cause it to pull away from the sealant and therefore cause premature failure of the insulating glass unit. Many window units tend to fail due to such stress cracks or loss of seal resulting in water vapor condensation which is deposited inside the panes and observed as window fogging. Such a condition results in a warranty callback and a window replacement.

Although the issue of thermal expansion is important to window durability, the most common spacer material commercially used in the manufacture of such insulated glass units has been metal due to cost and a lack of viable alternate materials.

A final problem inherent in previous spacer arrangements is that a rigid spacer provides an excellent path for the transmission of sound from the outer panel to the inside panel. This poses a particular problem in high-noise areas such as airports, urban environments, and commercial office spaces. Other institutions such as hospitals and schools also have a need and performance mandate for low sound transmission glass units. For reasons of sound control, steel and other similar metals may be a poor material choice. Other spacer materials should be sought with the aim of improving acoustical performance of insulated glass units.

The prior art has attempted to overcome the drawbacks noted above by providing composite spacers commonly termed 'warm edge' spacers. For instance, U.S. Pat. No. 4,113,905 discloses a composite foam spacer for separation of double insulated glass panes. The spacer includes a thin extruded metal or plastic core and a relatively thick foam plastic layer cast to the core to form a 0.025 to 0.150 inch thick layer around the core. Such a spacer provides advantages due to the structural rigidity provided by the metal base but suffers from a relatively thin insulating layer resulting in unacceptable thermal transfer.

U.S. Pat. Nos. 4,222,213 and 5,485,709 disclose additional composite spacers. Both patents disclose a thin plastic insulation which is in contact with one glass surface and thereafter fitted by contact pressure or friction over a portion of a conventional extruded or roll-formed metal spacer or plastic/metal composite. The plastic insulating overlay can be formed over a conventional extruded metal spacer and from an extrudable thermoplastic resin. However, the force fit and the bi-material construction of such a spacer can result in separation of the two components with changes in temperature due to the different thermal expansion coefficients of the metal and the plastic and again allow for substantial thermal bridging across the structure. These features are undesirable.

Descriptions of additional novel composite window unit spacer designs can also be found in U.S. Pat. Nos. 6,035,603, 6,581,341, 6,989,188 and 7,270,859.

Accordingly, what is needed is an insulating spacer which creates a thermally insulating bridge between spaced-apart panes in a multiple pane, insulated glass unit which overcomes the above-noted drawbacks.

SUMMARY OF THE INVENTION

It is an object of the present invention to provide an improved thermally insulating spacer for a multiple pane, insulated glass unit which solves or overcomes the drawbacks noted above with respect to conventional spacers.

It is another object of this invention to create a thermally insulating bridge to reduce heat transfer from one pane of the window (glass or Polyethylene Terephthalate—PET, also known as Mylar) to another through the insulating spacer of the present invention. This invention thus keeps the inner pane of material (glass or Mylar) several degrees warmer than it might otherwise be in the winter, while preventing condensation that otherwise may occur.

It is another object of the present invention to provide an insulating spacer with a coefficient of expansion approximately equal to that of glass.

It is another object of the present invention to provide an improved method of manufacturing an improved composite insulating spacer to provide an improved and satisfactory bonding between glass, on the one hand, and the metal and aerogel materials in such a composite spacer, on the other hand.

It is still another object of the present invention to improve thermal insulation, particularly in buildings, and to provide for improved multiple insulated glass assemblies.

The present invention provides an insulating spacer for spacing apart panes of a multiple pane window unit, for example, and for defining an insulated space between the panes. The novel material incorporated into the insulating spacer is an aerogel composite, specifically a fiber reinforced aerogel (FRA). The novel spacer may consist entirely of an FRA, consist of a treated FRA, or the spacer may consist of an FRA profile bonded to a metal or plastic substrate for greater dimensional stability or improved manufacturability.

Fiber reinforced aerogels (FRA) have the lowest thermal conductivity value of any material currently used in building construction. They have thermal conductivities of 12 to 18 mW/m-K. By comparison, metals such as copper, aluminum, and stainless steel have much higher thermal conductivities of 36,000 mW/m-K, 20,400 mW/m-K, and 12,000 mW/m-K respectively. Even closed cell foams designed for thermal insulation such as expanded polystyrene and polyisocyanurate have thermal conductivities of 32 and 24 mW/m-K respectively. In addition to their low thermal conductivity, FRAs exhibit good moisture and water vapor resistance. The FRA is hydrophobic with excellent resistance to moisture. The material's series of nanopores embedded into a fibrous matrix form a tortuous gas-resistive network that resists vapor penetration, condensation and ice crystallization. FRAs also exhibit good dimensional stability and structural integrity over a broad range of temperatures. Typically available FRAs have a range of service temperatures over 200 degrees C., which is greater than that required for the building envelope. Across the service temperature, the FRA remains flexible and is not subject to contraction, thermal shock or degradation from thermal cycling as are foams. Last, FRAs have a coefficient of thermal expansion similar to that of metal and glass. The result is that once these materials are bonded together; there are no additional stresses due to temperature change. Therefore, the present invention improves the thermal performance of the insulated glass units along the edge of the assembly where unwanted heat transfer is a particular problem.

The construction of such fiber reinforced aerogel materials suitable for construction applications is disclosed in U.S. Pat. No. 6,068,882. Described in general process steps, the fiber reinforced aerogel (FRA) is prepared by impregnating a fibrous matrix with an aerogel precursor solution so that a liquid phase is placed around every fiber and then, without aging of the precursor solution to form a gel, supercritically drying the impregnated matrix under conditions such that substantially no fiber-fiber contacts are present. The resulting composite insulation contains aerogels distributed uniformly throughout the fibrous matrix. This general process is discussed in detail below.

To fully obtain the benefit of the composite configuration, each fiber within the fibrous matrix is completely surrounded by aerogels such that all fiber-fiber direct contact is avoided. The substantial absence of fiber-fiber contacts is accomplished by a combination of (i) selection of compatible fibrous matrices and aerogels, (ii) impregnation of the fibrous matrix with an aerogel sol so that the liquid phase surrounds every fiber, and (iii) controlled aerogel processing procedures.

In the process of the FRA manufacture, the principal synthetic route for the formation of aerogels is the hydrolysis and condensation of an alkoxide. Major variables in the aerogel formation process are the type of alkoxide, solution pH, and alkoxide/alcohol/water ratio. Control of these variables permits control of the growth and aggregation of the aerogel species throughout the transition from the "sol" state to the "gel" state during drying at supercritical conditions. For low temperature applications, the preferred aerogels are prepared from silica, magnesia, and mixtures thereof.

After formation of the alkoxide-alcohol solution, water is added to cause hydrolysis so a metal hydroxide in a "sol" state is present. Techniques for preparing such aerogel "sol" solutions are well known in the art. (See, for example, S. J. Teichner et al., "Inorganic Oxide Aerogel," Advances in Colloid and Interface Science, Vol. 5, 1976, pp 245-273, and L. D. LeMay, et al., "Low-Density Microcellular Materials," MRS Bulletin, Vol. 15, 1990, p 19).

Next, the fibrous matrix may be placed in an autoclave, the aerogel-forming components (metal alkoxide, water and solvent) added thereto, and the supercritical drying then immediately commenced. Supercritical drying is achieved by heating the autoclave to temperatures above the critical point of the solvent under pressure, e.g. 260° C. and more than 1,000 psi for ethanol.

Following a dwell period (commonly about 1-2 hours), the autoclave is depressurized to the atmosphere in a controlled manner, generally at a rate of about 5 to 50, preferably about 10 to 25, psi/min. Due to this controlled depressurization there is no meniscus in the supercritical liquid and no damaging capillary forces are present during the drying or retreating of the liquid phase. As a result, the solvent (liquid phase) (alcohol) is extracted (dried) from the pores without collapsing the fine pore structure of the aerogels, thereby leading to the enhanced thermal performance characteristics.

A commercially available fiber reinforced aerogel product is Spaceloft, manufactured by Aspen Aerogels of Northborough, Mass. To date, fiber reinforced aerogels have been used as interlayers over stud framing in walls, thermal clothing, and cladding for pipes and ducts.

As will be appreciated by those skilled in the art, in addition to the multiple glass or Mylar panes and the aerogel spacer, the assembly may employ polyisobutylene (PIB), butyl, hot melt, or any other suitable sealant or butylated material as a sealant and adhesive. Sealing or other adhesion for the insulating spacer may be achieved by providing special adhesives, e.g., acrylic adhesives, pressure sensitive adhesives, or hot melt adhesive. Multiple sealant layers may be used. By providing at least two different sealing materials, the result is that discrete and separate sealing surfaces are in place to protect the spacer. This is useful in the event that one seal is compromised. The sealant materials may be embedded within one another.

In addition to the flexible, thermally insulating spacer, the assembly may include a vapor barrier about the rear face of the spacer. Regarding the vapor barrier, it may be a metalized film or other material well known to those skilled in the art. Other suitable examples will be readily apparent.

A better understanding of these and other advantages of the present invention, as well as objects attained for its use, may be had by reference to the drawings and to the accompanying descriptive matter, in which there are illustrated and described preferred embodiments of the invention.

BRIEF DESCRIPTION OF THE DRAWINGS

FIGS. 2*a* to 2*i* are alternate embodiments of a single seal insulating spacer of the type shown in FIG. 1.

Throughout the views, like or similar reference numerals have been used for like or corresponding parts.

DETAILED DESCRIPTION OF THE PREFERRED EMBODIMENTS

Figure 1:
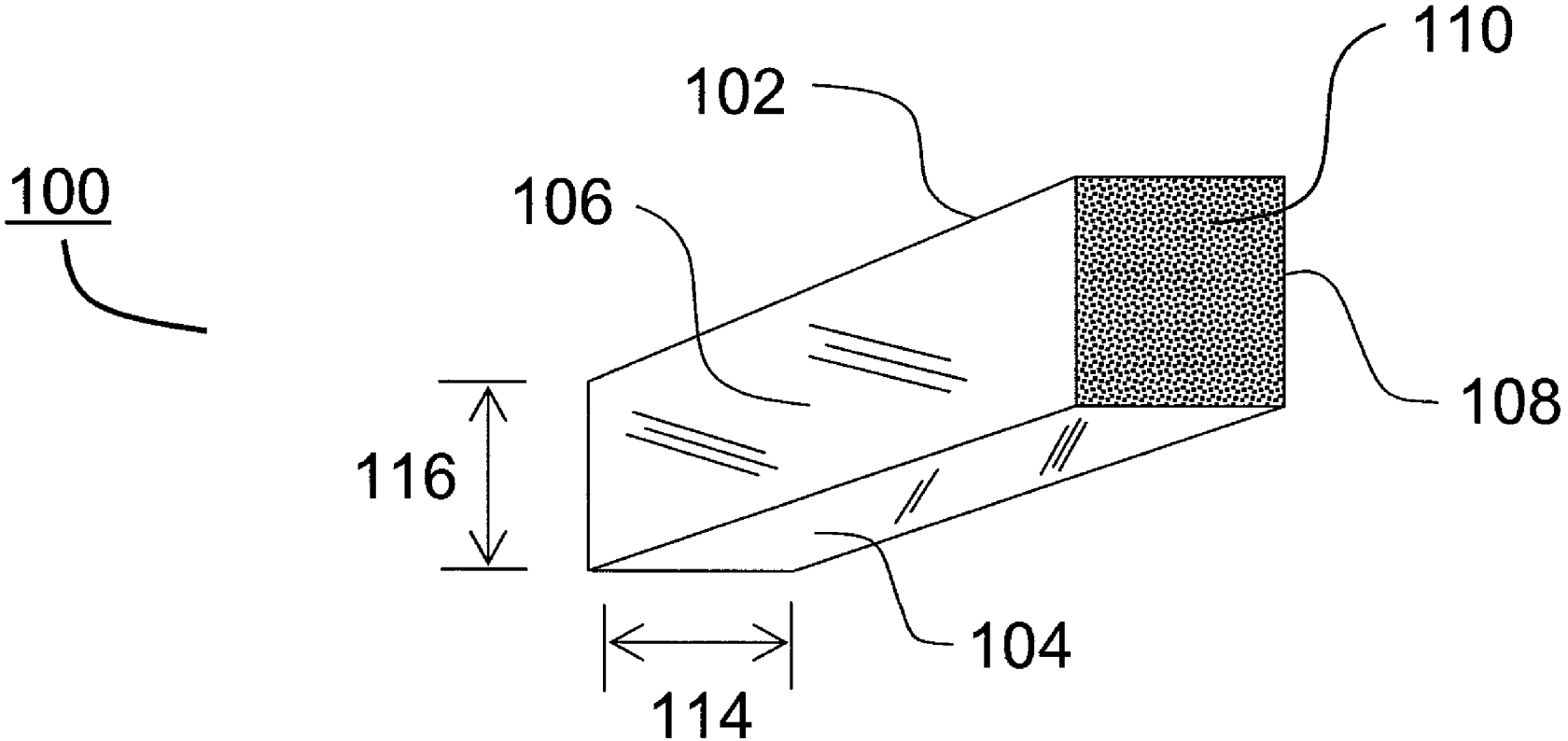
FIG. 1 is a perspective view of one embodiment of the present invention.
Figure 3:
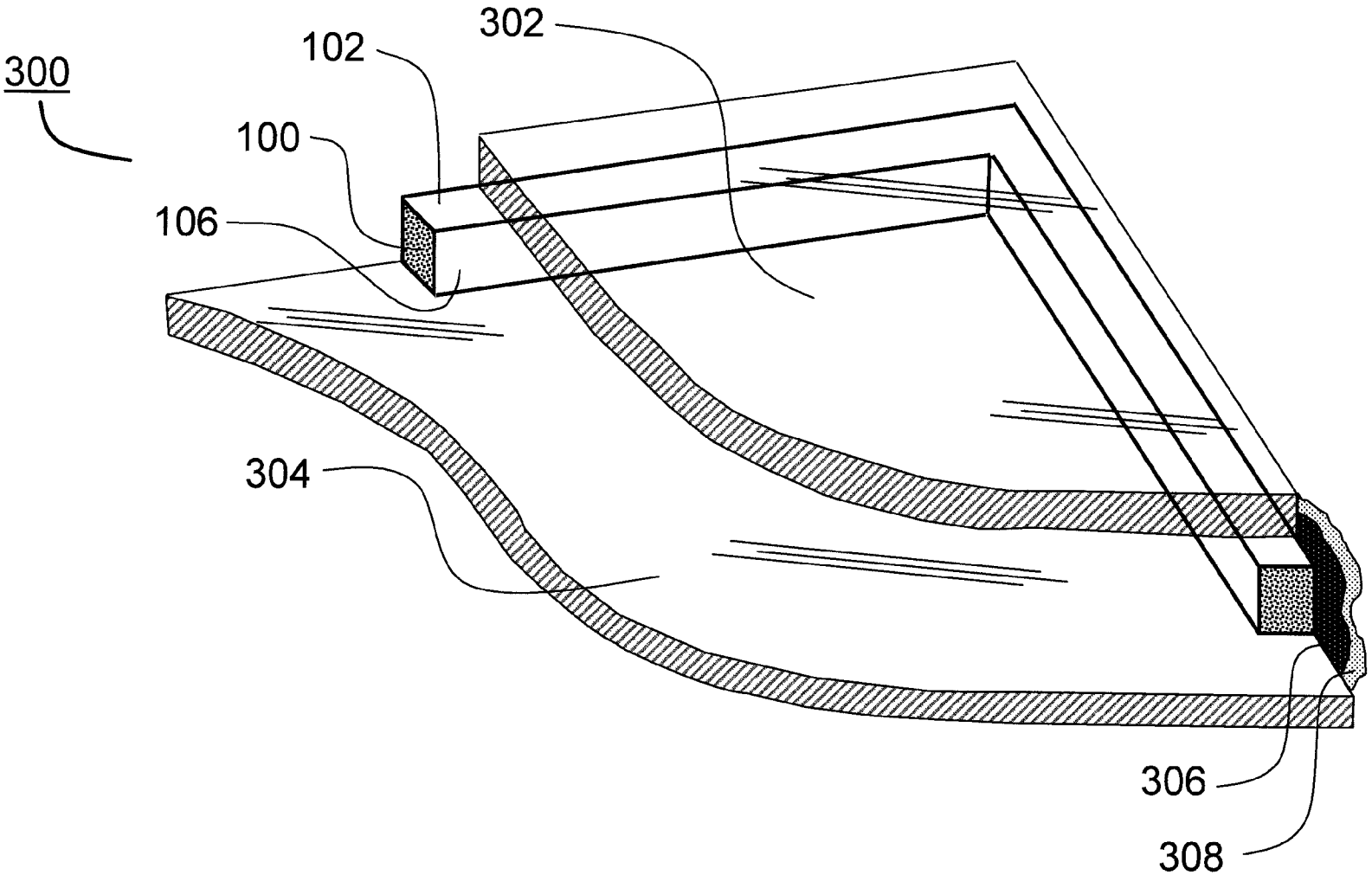
FIG. 3 is a perspective view of the present invention in-situ between substrates typical of a dual glaze insulated glass unit.

FIG. 1 shows one embodiment of the present invention in which 100 globally denotes the novel spacer. In the embodiment shown, the spacer 100 includes a pair of glass contact surfaces 102 and 104 in spaced relation to each other so as to separate two glass or plastic panes by a given distance. The spacer body 100 includes a front or inwardly directed face 106, and a rear or outwardly directed face 108. The front face 106 faces the interior of an insulated glass unit assembly, as shown in FIG. 3. As shown in the example embodiment, the four faces, 102, 104, 106 and 108 are each coated or clad with a material making the spacer suitable for direct bonding between two glass sheets. This coating and/or cladding may be a vinyl or other plastic, a nonwoven fabric or aromatic nylon, a butyl or other durable coating, or even a metal foil or other thin metallic skin. The spacer 100 has a fiber reinforced aerogel core 110. The cladding material may be added to reduce dust shedding and to improve the aesthetic appearance of the unclad spacer material. The cladding may be permanently applied either by direct adhesion to the four surfaces 102, 104, 106 and 108 using a commercially available adhesive such as Super 77 Spray manufactured by 3M of St. Paul, Minn. Alternately, the spacer 110 may be wrapped by a non-woven fabric and welded to itself in a seam along the outer face 108 forming a sleeve. Dimensions 114 and 116 may be varied between about 2 to 50 mm to best suit the thermal, structural, and product cost needs of the assembly.

FIGS. 2*a* through 2*h* show further embodiments of the spacer as illustrated in FIG. 1. As shown in FIGS. 2*a* through 2*h*, these spacer embodiments now incorporate structural elements 112 in addition to the fiber reinforced aerogel 110. In particular, FIGS. 2*a*, 2*b*, and 2*c* show spacers with stiffening material 112 exposed at inward facing surface 106. FIG. 2*d* illustrates a proposed embodiment where the stiffening material 112 is completely encapsulated by the aerogel 110. FIGS. 2*e* through 2*i* again show stiffening material 112 at the inward face 106 though the stiffening material 112 could also face outward. In FIG. 2*h* the stiffening material also extends into the middle of the spacer and in FIG. 2*i*, the stiffening material extends along the two sides of the spacer which will be in contact with the two glass sheets. In each of the examples, the stiffening material can be made of a metal, resin impregnation or hardening, or suitable plastic material.

FIG. 3 is an embodiment showing the spacer 100 as typically employed in an insulated glass assembly 300. Spacer 100 is positioned and bonded between two glass panels or sheets 302 and 304 about the perimeter. With greater detail concerning FIG. 1, the contact surfaces 102 and 104 and front face 106 each include a first cladding material which may comprise, as an example, a non-woven sheet. A first sealant 306 is shown at surface 108, and adjacent to this first sealant there is included a second sealant 308 or water vapor barrier differing from the first coat 306. Examples of probable vapor barrier materials suitable for use as the first sealant and the second sealant include polyisobutylene, polyurethane, polysulphide, 1-part silicone, and 2-part silicone. Additional film and foil sealants include polyester films, polyvinylfluoride films, metal films or foils, and any other appropriate material which prohibits the transfer of vapor. In addition, the vapor barrier may be metalized. A useful example to this end is metalized Mylar film. Other suitable materials for the second sealant layer include acrylic adhesives, pressure sensitive adhesives, hot melt, polyisobutylene or other suitable butyl materials known to have utility for bonding such surfaces together.

Figure 4:
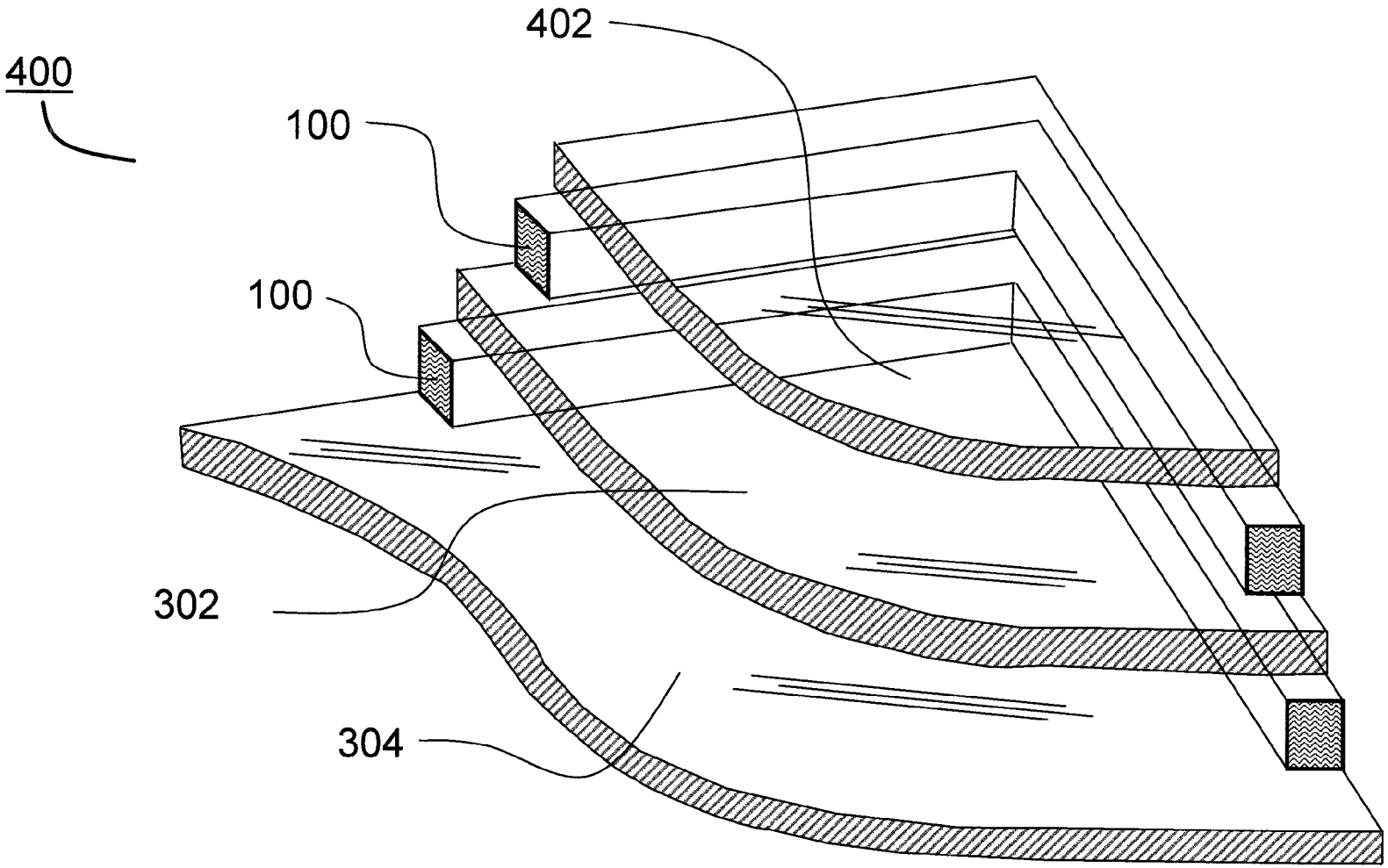
FIG. 4 is a perspective view of the present invention in-situ between substrates typical of a triple glaze insulated glass unit.

FIG. 4 is another embodiment of the spacer 100 which would be typically employed in a triple glazed insulated glass assembly 400. Two spacers 100 are positioned and bonded as shown between three glass panels or sheets 302, 304 and 402 about their perimeters. The surface treatments of spacer 100 and the addition of adhesives, sealants and vapor barriers are the same as with assembly 300 shown in FIG. 3.

Figure 5:
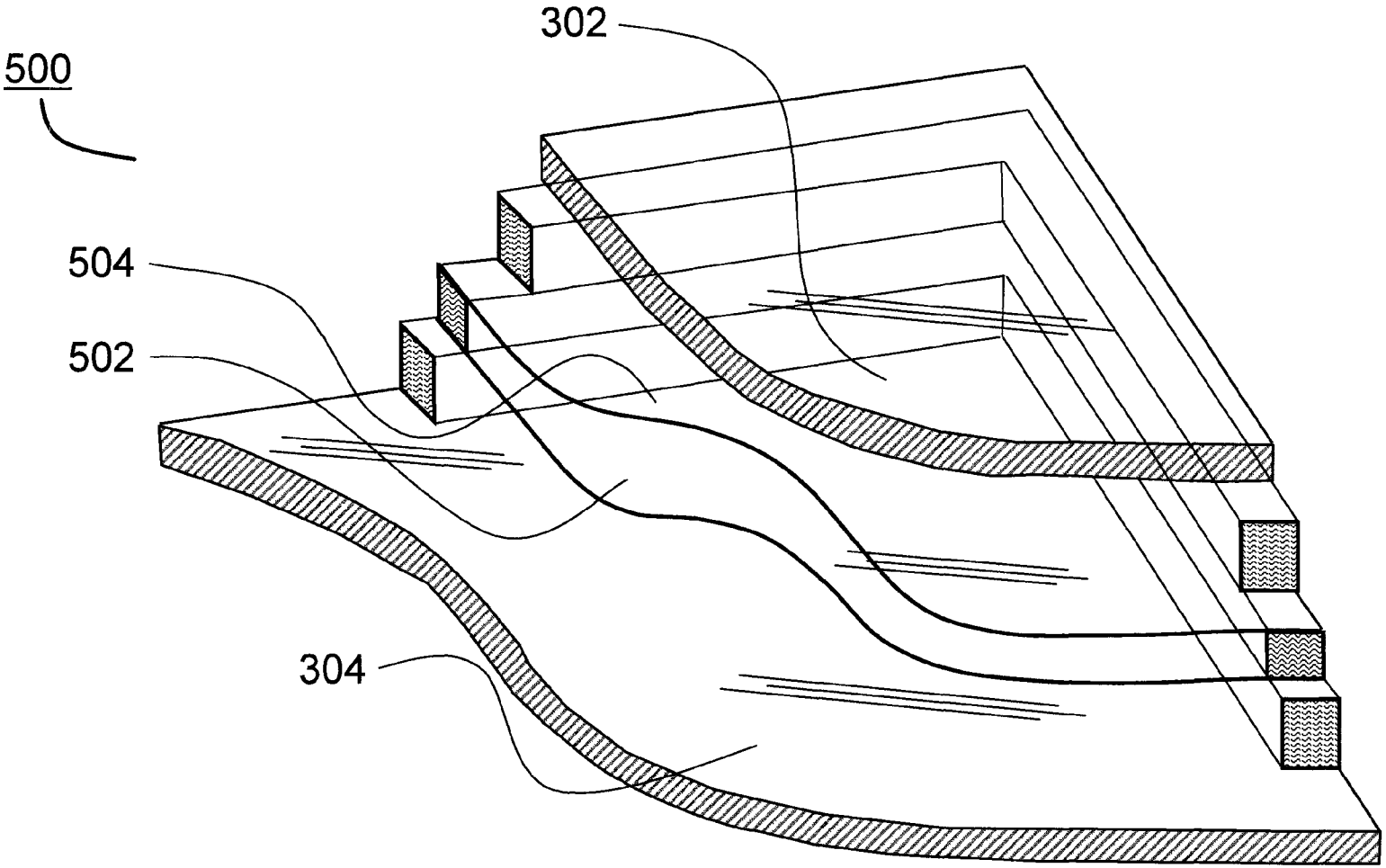
FIG. 5 is a perspective view of the present invention in-situ between substrates typical of a heat mirror glass unit (heat mirror embodiment).

FIG. 5 shows three spacers 100 which would be typically employed in an insulated glass assembly 500. In this case, assembly 500 represents a high thermal performance design termed a heat mirror unit. Three spacers 100 are positioned and bonded three times between a total of four panes or sheets 302, 304 and 502 and 504 about their perimeters. Sheets 502 and 504 are each a special multi-layer metalized sheet of Mylar designed to reflect infrared energy. They are typically much thinner than traditional glass sheets and are considered non-structural. The surface treatments of each spacer 100 and the addition of adhesives, sealants and a vapor barrier are the same as with assembly 300 shown in FIG. 3.

Figure 6:
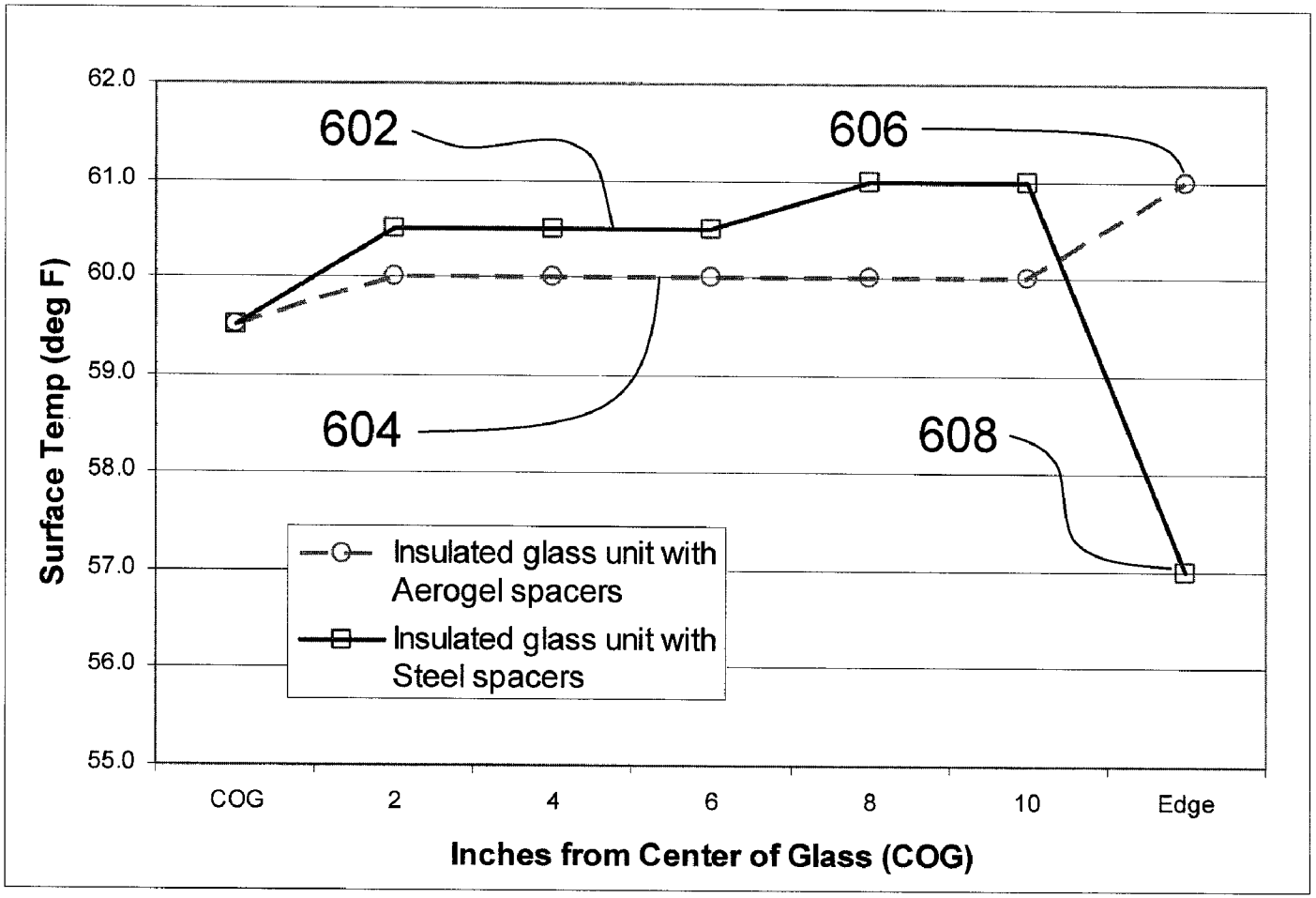
FIG. 6 is a graph of the thermal performance of one embodiment of an aerogel spacer window versus that of a traditional steel spacer window.

FIG. 6 shows the thermal performance of two insulated glass units. The two curves 602 and 604 represent window assemblies similar to those shown in FIG. 4 whereby material 304 is ⅛ inch thick glass coated with Cardinal 272 LoE2 coating, material 302 is a coated Mylar film SC75 manufactured by Southwall Technologies of Palo Alto, Calif. and material 402 is ⅛ inch thick clear glass. For curve 602, the spacer 100 is 11/32 inch high steel tubing manufactured by AllMetal. For curve 604, the spacer 100 is ⅜ inch thick uncoated FRA. Both windows are shown separating an environment of approximately 20 degrees Fahrenheit from an environment of approximately 70 degrees Fahrenheit. Temperature data point 608, is taken at the warm side glass surface in a location over the metal spacer. It shows that the heat transfer at the insulated glass unit edge is much greater than the heat transfer through the center of the unit (i.e. more heat is leaking through the spacer than through the center of the glass and thus the edge of the window adjacent the spacer is colder than the center of the glass). However, the insulated glass unit employing FRA as the spacer shows improved thermal insulation at the edge 606. As with temperature data point 608, the temperature corresponding to data point 606 is taken at the warm side glass surface in a location over the FRA spacer. In this location, the insulative value of the spacer element is greater than that of the center of glass, hence a warmer surface temperature adjacent the spacer than adjacent the center of the glass contrary to the prior art spacer structure (i.e. surprisingly, less heat is leaking through the spacer than is leaking through the center of glass). It is therefore shown that the proposed invention greatly reduces heat loss over existing technology.

Figure 7:
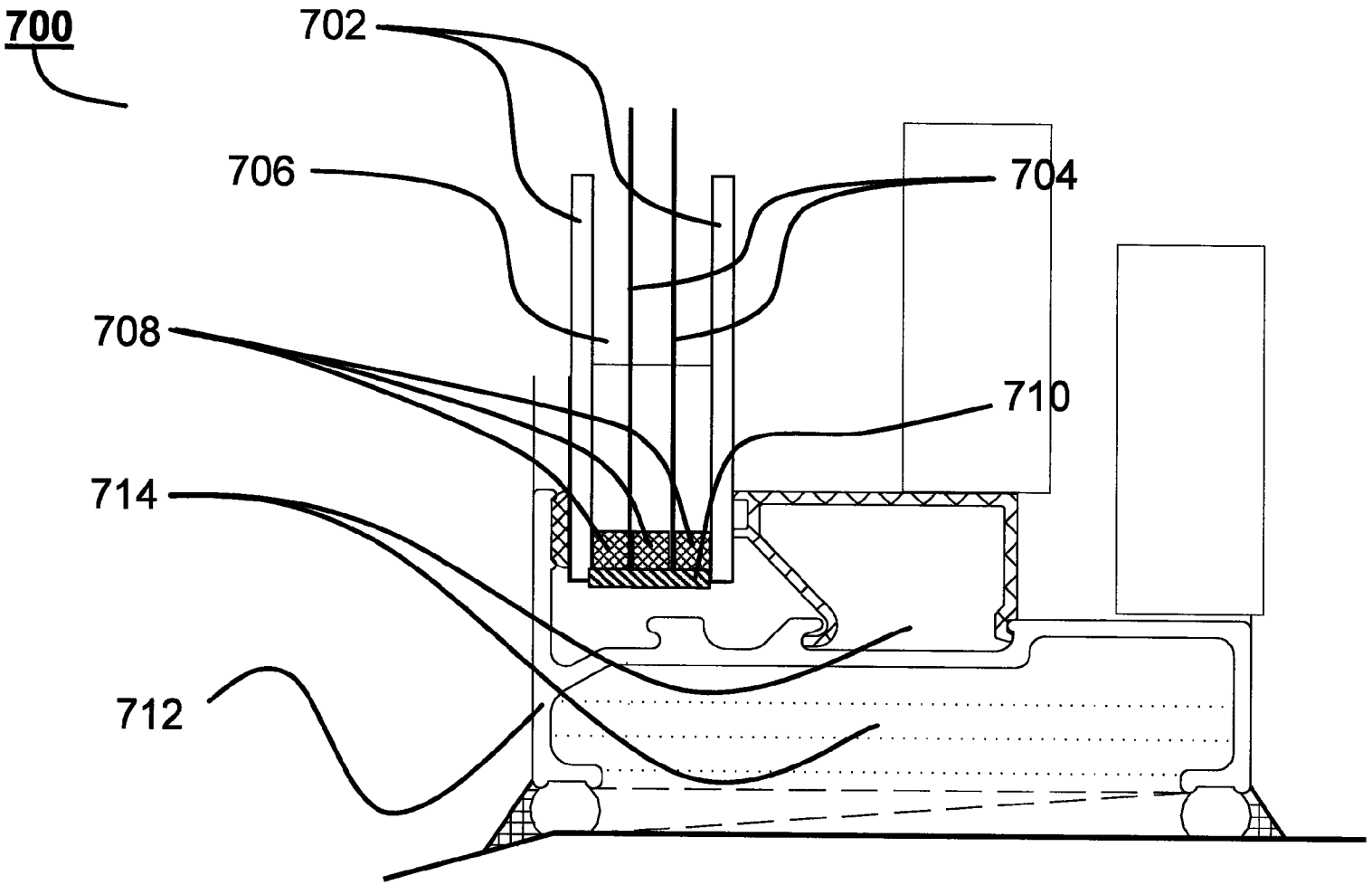
FIG. 7 is a cross section view of one embodiment of a window assembly that incorporates the insulated glass unit into a window frame.

FIG. 7 is a cross section view of the present invention incorporated into a typical window frame. Only the lower half of the window is represented. The upper section of the window and frame would be a mirror image of that shown here. The embodiment presented is FIG. 7 was modeled for thermal performance using industry standard window prediction software, THERM. THERM is a state-of-the-art, computer program developed at Lawrence Berkeley National Laboratory for use in modeling the heat transfer across building components such as windows, walls, and doors, where thermal bridges are of concern. In the embodiment modeled as a 1.22 m by 1.52 m window, the following elements were used. Components 702 were 4 mm thick glass coated with a Low emissivity coating, $LoE^3$-366 manufactured by Cardinal Glass of Eden Prairie, Minn. Components 704 were Mylar film SC75 manufactured by Southwall Technologies of Palo Alto, Calif. The voids of the insulated glass unit 706 were filled with Krypton gas, a typical thermal insulator. The insulated glass unit was sealed by a 3 mm thick layer of polyurethane sealant 710, as manufactured by PRC-DeSoto International of Glendale, Calif. The window frame 712 used in this embodiment was a Series 400 fiberglass frame manufactured by Inline Fiberglass of Toronto, Ontario. Two cavities within the fiberglass frame 712 were filled with an expanding polyurethane foam 714 manufactured by BioBased Systems of Rogers, Ark. The present embodiment was modeled with two different window spacer materials 708. In a base case, spacers 708 were 9 mm deep steel tubes rolled and welded to a square cross section. In a second modeling case, the spacers 708 consisted of the 9 mm deep fiber reinforced aerogel as shown in FIG. 1. For the window model using steel spacers 708, the U-factor for the total windows was 0.104. For the window model using fiber reinforced aerogel spacers 708, the U-factor for the total windows was 0.076. This represents a thirty seven percent (37%) improvement in the thermal performance of the system, just by replacing the window spacer material and leaving all other window components unchanged. This represents an astounding improvement over current window technologies.

Other embodiments of this invention will be obvious in view of the above descriptions.

What is claimed is:

1. Structure which comprises:

at least two sheets of glass;

a spacer positioned and bonded between said two glass sheets about the perimeter of said two glass sheets, said spacer including a first contact surface, a second contact surface and a front surface facing into the space between said at least two sheets of glass, said first contact surface, said second contact surface and said front surface each including a first cladding material and further wherein said spacer comprises:

a fiber reinforced aerogel forming a cross section with at least four sides on an outer surface;

a coating on said fiber reinforced aerogel suitable for allowing the spacer to be bonded to glass;

said fiber reinforced aerogel having a coefficient of thermal expansion with a value about that of glass and at least one additional structural element to stiffen said aerogel; wherein at least one side of the aerogel is free of the structural element;

wherein said first cladding material comprises a non-woven sheet;

a first sealant comprising a vapor barrier on a surface of said spacer facing away from said front surface of said spacer;

including a second sealant overlying said first sealant and of a different material than said first sealant.

2. Structure as in claim 1 wherein said second sealant comprises a water vapor barrier differing from said first sealant.

3. Structure as in claim 2 wherein said first and said second sealant are each selected from a group consisting of polyisobutylene, polyurethane, polysulphide, 1-part silicone, and 2-part silicone, polyester films, polyvinylfluoride films, any other appropriate material which prohibits the transfer of vapor, a metalized film, and a metalized Polyethylene Terephthalate (PET) film.

4. Structure as in claim 2 wherein said second sealant is selected from the group of materials consisting of acrylic adhesives, pressure sensitive adhesives, hot melt, polyisobutylene, polyurethane, polysulphide, and butyl materials known to have utility for bonding to said first sealant.

5. Structure as in claim 1 including a third sheet of glass separated from one of said two glass sheets by a second spacer bonded between said one of said two glass sheets and said third sheet of glass about the perimeter of said one of said two glass sheets and said third sheet of glass, said second spacer including a first contact surface, a second contact surface and a front surface facing into the space between said third sheet of glass and said one of said two glass sheets, said first contact surface of said second spacer, said second contact surface of said second spacer and said front surface of said second spacer each including a first cladding material.

6. Structure as in claim 1 including an intermediate structure between said two glass sheets, said intermediate structure comprising one or two high thermal performance sheets, said one or two high thermal performance sheets being separated around their periphery by a first spacer, said intermediate structure being separated from said two glass sheets by a second and a third spacer around their periphery, each of said two spacers separating said intermediate structure from a corresponding one of said two glass sheets, and further wherein said first, second and third spacers comprise:

a fiber reinforced aerogel;

a coating on said fiber reinforced aerogel suitable for allowing the spacer to be bonded to glass; and said fiber reinforced aerogel having a coefficient of thermal expansion with a value about that of glass.

7. Structure as in claim 6 wherein said one or two high thermal performance sheets each comprise a multi-layer metalized sheet of Polyethylene Terephthalate (PET) which reflects infrared energy, said two multi-layer metalized sheets of Polyethylene Terephthalate (PET) being separated around their periphery by a spacer comprising aerogel.

8. Structure as in claim 7 including at least one sealant material around the periphery of said structure.

9. Structure as in claim 8 wherein said at least one sealant is selected from the group consisting of polyester films, polyvinylfluoride films, any other appropriate material which prohibits the transfer of vapor, a metalized film, and a metalized Polyethylene Terephthalate (PET) film.

10. Structure which comprises:

at least two sheets of glass;

a spacer positioned and bonded between said two glass sheets about the perimeter of said two glass sheets, said spacer including a first contact surface, a second contact surface and a front surface facing into the space between said at least two sheets of glass, said first contact surface, said second contact surface and said front surface each including a first cladding material and further wherein said spacer comprises:

a fiber reinforced aerogel forming a cross section with at least four sides on an outer surface;

a coating on said fiber reinforced aerogel suitable for allowing the spacer to be bonded to glass;

said fiber reinforced aerogel having a coefficient of thermal expansion with a value about that of glass and at least one additional structural element to stiffen said aerogel; wherein at least one side of the aerogel is free of the structural element;

a first sealant comprising a vapor barrier on a surface of said spacer facing away from said front surface of said spacer;

including a second sealant overlying said first sealant and of a different material than said first sealant.

11. The structure as in claim 10 wherein said first cladding material comprises a plastic.

12. The structure as in claim 11 wherein said plastic is vinyl.

13. The structure as in claim 10 wherein said first cladding material is selected from the group consisting of aromatic nylon and a butyl coating.

14. The structure as in claim 10 wherein said first cladding material is selected from the group consisting of a metal foil and a metallic skin.

* * * * *